United States Patent [19]

Walker, Jr. et al.

[11] Patent Number: 4,523,373

[45] Date of Patent: Jun. 18, 1985

[54] METHOD OF ASSEMBLING AN ACTUATING LEVER TO A POTENTIOMETER

[75] Inventors: Bertice E. Walker, Jr., Williamsburg; Richard J. Hyder, Newport News, both of Va.

[73] Assignee: Allied Corporation, Morristown, N.J.

[21] Appl. No.: 399,539

[22] Filed: Jul. 19, 1982

[51] Int. Cl.[3] ..... G05G 1/00

[52] U.S. Cl. ..... 29/593; 29/610 R

[58] Field of Search ..... 29/593, 595, 610 R; 324/63; 338/184, 211, 92, 121, 135, 195, 334

[56] References Cited

U.S. PATENT DOCUMENTS

| | | | |
|---|---|---|---|
| 1,496,745 | 6/1924 | Scott | 338/89 |
| 1,992,410 | 2/1935 | Benkelman | 338/138 |
| 2,256,473 | 9/1941 | DeGiers | 338/135 |
| 2,902,662 | 9/1959 | Wittlake | 338/51 |
| 4,355,293 | 10/1982 | Driscoll | 338/211 |

FOREIGN PATENT DOCUMENTS 3103212 11/1981 Fed. Rep. of Germany .

*Primary Examiner*—Howard N. Goldberg
*Assistant Examiner*—P. W. Echols
*Attorney, Agent, or Firm*—Russel C. Wells

[57] ABSTRACT

A method of assembling an actuating lever (10) to a potentiometer (12) for use in electronic engine control systems for internal combustion engines as a throttle position sensor to generate electrical signals indicating the angular position (A°) of the throttle blade. In such systems, there is usually one known or "home" position from which the position of the throttle blade is determined in order to determine the injection demands of the engine. The method herein is for accurately locating an actuating lever (10) to the moveable contact of the potentiometer (12) so that at the home position, the signal generated by the potentiometer is a known value. In addition, the potentiometer only needs to be adjusted on the throttle body once it is assembled thereto to account for throttle body tolerances, thereby satisfying rigid engine control requirements which require the positioning of the potentiometer to be accurately known.

1 Claim, 4 Drawing Figures

METHOD OF ASSEMBLING AN ACTUATING LEVER TO A POTENTIOMETER

The invention herein pertains to a method of assembling an actuating lever to a potentiometer apparatus so that a known "home" position is electrically identified. In particular, one such potentiometer apparatus is that described and claimed in a copending U.S. Pat. No. 4,335,293 issued on Oct. 19, 1982 by Barry J. Driscoll and entitled "Electrical Resistance Apparatus Having Integral Shorting Protection" which is a continuation of U.S. Ser. No. 86,911 filed on Oct. 22, 1979 now abandoned.

Such electrical resistance apparatus or potentiometer, may be used in electronic engine control systems for internal combustion engines as a sensor for sensing the movement and angular position of throttle blades. When used in such an application, the home position of the throttle blade is required to be accurately known as must at the idle position, where the throttle blade allows a small quantity of air flow through the throttle body the wide open throttle position where its impedance to air flow is a minimum, and the closed throttle position where its impedance to air flow is a maximum. Thus, it is essential that each and every throttle blade position between the maximum and minimum air impedance position also be accurately known.

Under present Federal Regulations on Emission Standards, internal combustion engines in motor vehicles must be accurately set up at the factory in compliance with these standards. The present throttle position sensors have accurate mounting apertures or slots, allowing each sensor to be adjusted to each engine to comply with the standards. Unfortunately such adjustment may work loose and the electrical information generated by the sensor changed.

It is an advantage of the present invention to allow the mounting apertures to be used to compensate for tolerance build up of the engine assemblies and to rule out all but small tolerance positioning of the actuating lever of the sensor. In addition when the sensor is replaced the electrical information signal output is unaffected. This is accomplished by assembling the actuating lever to the moveable contact means of the sensor at a predetermined position with respect to at least one of the mounting apertures and at an electrical signal output representing the home position of the sensor.

It is another advantage of the present invention to reduce the tolerance build-up of the individual members of the throttle position sensor to a very tight tolerance without changing the manufacturing tolerances of the individual members.

These and other advantages will become apparent in the following description and drawings wherein.

Figure 1:
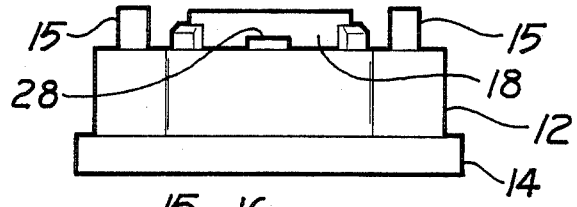
FIG. 1 is a side view of a potentiometer located in a fixture prior to assembly of an actuating lever.
Figure 2:
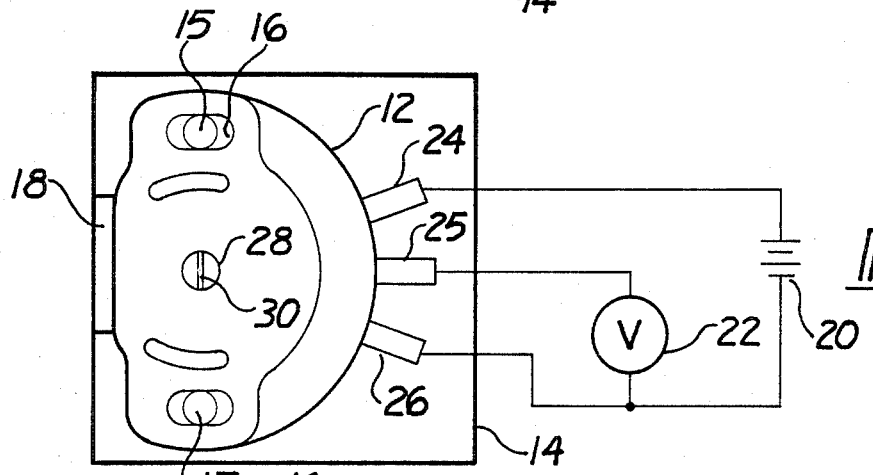
FIG. 2 is a plan view of the steps of locating and electrically coupling a voltmeter to the potentiometer.
Figure 3:
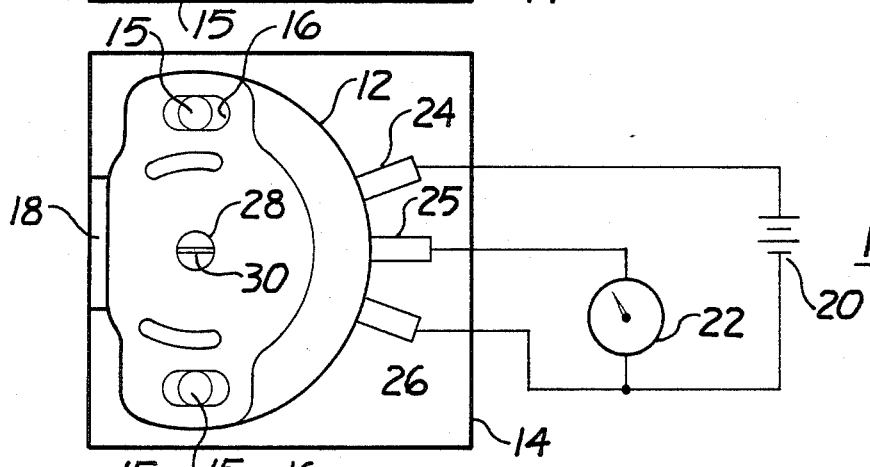
FIG. 3 is a plan view of moving and holding the moveable contact.

Referring to the figures by the characters of reference, the several steps of the method of assembling an actuating lever 10 to a potentiometer 12 are illustrated. The potentiometer or sensor 12 may be that device which is described and claimed in copending U.S. Pat. No. 4,355,293 by Barry J. Driscoll and entitled "Electrical Resistance Apparatus Having Integral Shorting Protection" which is a continuation of U.S. Ser. No. 86,911 filed on Oct. 22, 1979 now abandoned. Both of the above are expressly incorporated herein by reference.

The potentiometer 12 is located on a plate 14 through the mounting apertures 16 in its housing on at least two locating pins 15 extending from the plate and against a stop means 18. This mounting provides stability for locating the lever 10. As the function of the potentiometer 12 is to generate an electrical signal based on the position of a moveable contact means along a resistance track with respect to one end of the resistance track, a power supply 20 and an electric meter 22 are connected to the terminals 24–26, of the potentiometer 12. The "home" position of the sensor 12 must be that position wherein the lever 10 is at an angular relationship with respect to a mounting aperture 16 and the output signal is at a predetermined ratio.

In the particular potentiometer 10 illustrated in the figures, there are three terminals 24–26 extending from the housing which are adapted to receive electrical connections. By connecting a known voltage value from a power supply 20 across the whole resistance track from the two outside terminals 24 and 26 of the potentiometer, which in the preferred embodiment is 5.00 volts, a voltmeter 22, connected between one end 26 of the track and the moveable contact means connected to the middle terminal 25, will accurately indicate the voltage across that position of the resistance track therebetween. The ratio of the resistance between the contact means and one end of the track and the total resistance of the track must be a predetermined value at the proper lever position.

Once the electrical connections are made, the moveable contact means is moved to a position wherein a predetermined value which represents the desired ratio as indicated above, is read on the meter 22. In the sensor 12 illustrated, the moveable contact means comprises electrical contacts mounted to a rotor 28 and by rotating the rotor 28 through an angular distance, the value on the meter 22 is brought to its predetermined value.

After the meter 22 reads the predetermined value, the rotor 28 is temporarily held from rotating. The value of the resistance or voltage ratio between the moveable contact means, the middle terminal pin 25, and one end of the resistance track, one end terminal pin 26 is equal to that required by an electronic control unit to indicate a "home" or reference position of the sensor 12.

Figure 4:
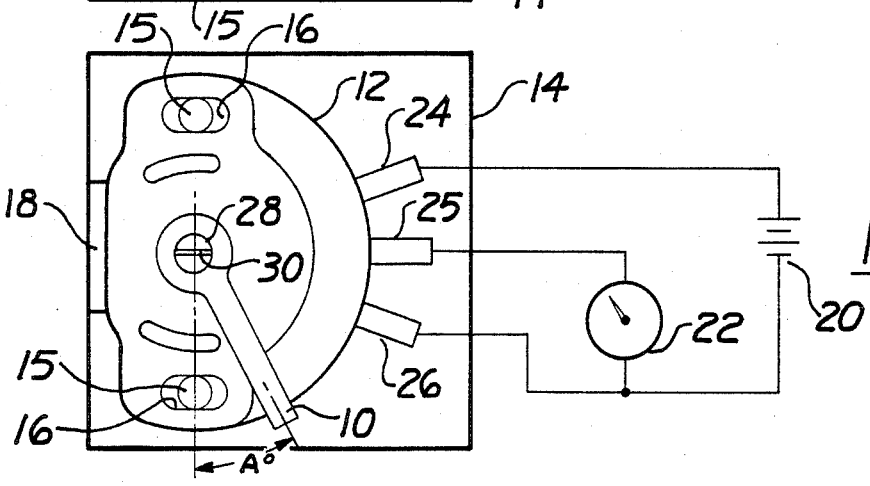
FIG. 4 is a plan view of attaching the lever to the potentiometer.

In the next step, the actuating lever 10 is attached to the rotor 28 at a predetermined angular relationship with at least one of the mounting apertures 16 of the potentiometer 12 housing. In FIG. 4, this is represented by the angular distance "A°". In order to secure the actuating lever 10, in the preferred embodiment, the lever 10 has an aperture which is pressed over the rotor 28 in an interference fit.

If it is desired to insure that the lever 10 will not work itself off the rotor 28 over the life of its use, another step would be to add a retaining ring, not shown, over the rotor 28 for holding the lever 10 in place.

In the particular embodiment illustrated, the rotor 28 has a slot means 30 across its end to facilitate rotation. The rotor 28 is rotated until the voltmeter 22 reads 0.500 volts with a known power supply voltage of 5.000 volts. This indicates that the position of the contacts on the moveable contact means and the end of the resistance track are electrically spaced apart and at the predetermined ratio. The angular distance A° is equal to 63° 30′.

In an automatic set up, in place of the power supply 20 and the electric meter 22, an extensive electromechanical means may be used and appropriately hooked up to the potentiometer 12. In response to electrical signals from the output of a comparator circuit, a drive mechanism may be actuated to rotate the rotor 28 until the comparator circuit indicates that the position of the moveable contact means is at the desired position.

There has thus been shown and illustrated a method for assembling an actuating lever 10 to a potentiometer 12 at a predetermined position "A" relative to at least one mounting aperture 16 of the potentiometer 12. The position of the lever 10, when assembled to the potentiometer 12, represents a predetermined known electrical position which corresponds to an identifiable position of a member being sensed by the potentiometer 12. Such position, when the potentiometer 12 is used as a throttle position angular sensor, may correspond to the idle speed position of an internal combustion engine and the output of the potentiometer 12 is an electrical signal indicating the same to an electronic control unit.

What is claimed is:

1. A method of assembling an actuating lever to the moveable contact means of a potentiometer, having at least one mounting aperture, to establish a known voltage ratio between the position of the moveable contact means and one end of the resistance track in the potentiometer, said method comprising the steps of:

locating the potentiometer in a fixed position relative to the at least one mounting aperture thereof;

electrically coupling a known, regulated power source across the resistance track in the potentiometer and an electric voltmeter between the moveable contact means and the one end of the resistance track in the potentiometer;

moving the moveable contact means intermediate the ends of the resistance track to position the voltmeter reading at a predetermined voltage value representing an effective ratio between the voltage drop from the moveable contact to the one end of the resistance track and the total voltage drop across the resistance track;

holding the moveable contact means in the moved position;

securely attaching the actuating lever to the moveable contact means in the moved position at an accurately predetermined relationship (A°) with the at least one mounting aperture of the potentiometer;

releasing the moveable contact means.

* * * * *